United States Patent [19]

Hogg

[11] 4,155,464

[45] May 22, 1979

[54] OFFSET JIB FOR CRANES

[75] Inventor: Theodore B. Hogg, Aurora, Ill.

[73] Assignee: Caterpillar Tractor Co., Peoria, Ill.

[21] Appl. No.: 750,992

[22] Filed: Dec. 15, 1976

[51] Int. Cl.[2] ..... B66C 23/06

[52] U.S. Cl. ..... 212/59 R; 212/144

[58] Field of Search ..... 212/55, 58 R, 58 A, 212/59 R, 59 A, 46 R, 46 A, 46 B, 35, 144; 52/111-116, 117, 641, 645-646

[56] References Cited

U.S. PATENT DOCUMENTS

| | | | |
|---|---|---|---|
| 1,920,370 | 8/1933 | Forsythe et al. | 212/59 R |
| 3,366,250 | 1/1968 | Grove | 212/55 |
| 3,698,569 | 10/1972 | Lamer | 212/55 |
| 3,732,988 | 5/1973 | Lamer | 212/55 |
| 3,785,505 | 1/1974 | Keller | 212/55 |
| 3,831,771 | 8/1974 | Wiencek | 212/55 |
| 3,944,082 | 3/1976 | Fritsch | 212/59 R |
| 3,968,884 | 7/1976 | Johnson et al. | 212/55 |

FOREIGN PATENT DOCUMENTS

| | | | |
|---|---|---|---|
| 2017713 | 7/1971 | Fed. Rep. of Germany | 212/55 |
| 1175243 | 3/1959 | France | 212/46 R |

*Primary Examiner*—Francis S. Husar
*Assistant Examiner*—R. B. Johnson
*Attorney, Agent, or Firm*—Phillips, Moore, Weissenberger, Lempio & Strabala

[57] ABSTRACT

A crane comprises a mobile vehicle having an upper frame rotatably mounted on a lower frame thereof. A boom has its rearward end pivotally mounted on the upper frame and a doubleacting hydraulic cylinder is pivotally interconnected between the upper frame and the boom to selectively raise and lower the same relative to ground level. A jib has its rearward end pivotally attached to a forward end of the boom by an elongated slot connection which permits the jib to be moved between a stored position in offset relationship adjacent to the boom and an extended position forwardly of the boom wherein the longitudinal axes of the jib and boom are parallel relative to each other.

15 Claims, 8 Drawing Figures

10
11
12
13
14
16
17
18
19
20
21
22
23
24
25
26
27
28
35
36
37
40
41
42
43
L1
L2
H
X
Y
III

OFFSET JIB FOR CRANES

BACKGROUND OF THE INVENTION

A conventional crane normally comprises an upper frame rotatably mounted on a lower frame or undercarriage and a boom pivotally mounted on the upper frame. The boom may be raised and lowered by a winch-controlled cable or hydraulic cylinders pivotally interconnected between the upper frame and the boom. A winch-controlled hoist line is normally entrained over a sheave rotatably mounted on a forward end of the boom to selectively raise or lower a work tool, such as a hook or bucket.

In order to obtain greater reach and to hold bulky loads away from the boom, a gib is oftentimes pivotally connected to a forward end of the boom for this purpose. A hoist line is then entrained over a sheave rotatably mounted on a forward end of the jib and separate cables are attached to the jib to selectively pivot the same on the boom. The jib is pivotally connected to the boom to permit it to collapse and fold inwardly under the boom to a stored position for transport purposes.

Such disposition interferes with the operator's visibility when the crane is driven to a remote job site. In addition, the space required beneath the boom must be substantially unobstructed to accommodate the jib and the length of the jib may have to be shorter than desirable. For example, a pair of laterally spaced hydraulic cylinders may be required for raising and lowering the boom since the jib must be accommodated therebetween.

SUMMARY OF THIS INVENTION

An object of this invention is to overcome the above, briefly described problems by providing a crane with means for storing a jib thereof in offset relationship relative to its boom when the jib is collapsed to its stored position for transport purposes. Such offset relationship increases the operator's visibility upon driving of the crane to a remote job site and also provides an unobstructed area between the boom and the vehicle on which it is mounted. For example, such area can now be utilized to accommodate a single double-acting hydraulic cylinder pivotally interconnected between the vehicle and the boom for selectively raising and lowering the same. In addition, the jib may be constructed longer than conventional ones.

The rearward end of the boom is pivotally mounted on a frame of the vehicle whereas the jib is attached on a forward end thereof. The attachment means, attaching the jib on the boom, permits the jib to be moved to a stored position adjacent to the boom wherein a longitudinal axis of the jib is disposed at an acute angle relative to a longitudinal axis of the boom to dispose a forward end of the jib in laterally offset relationship relative to the boom. Upon movement of the jib to an extended or working position forwardly of the boom, the longitudinal axes of the jib and the boom are disposed in parallel relationship relative to each other.

BRIEF DESCRIPTION OF THE DRAWINGS

Other objects of this invention will become apparent from the following description and accompanying drawings wherein.

DETAILED DESCRIPTION

Figures 1, 2:
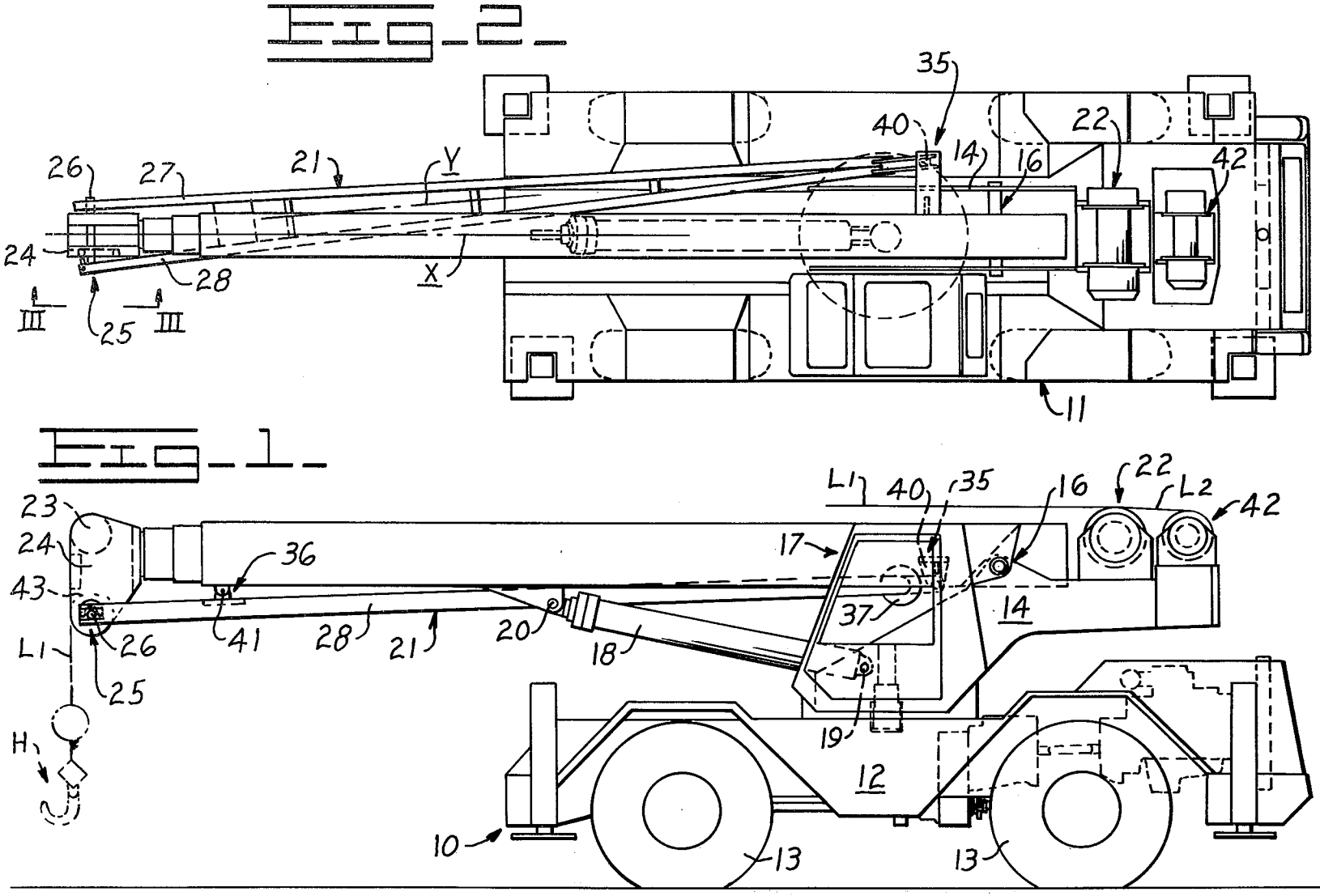
FIG. 1 is a side elevational view of a crane comprising a boom having a jib pivotally attached on a forward end thereof and disposed in a stored position thereon.
FIG. 2 is a top plan view of the crane.
Figure 3:
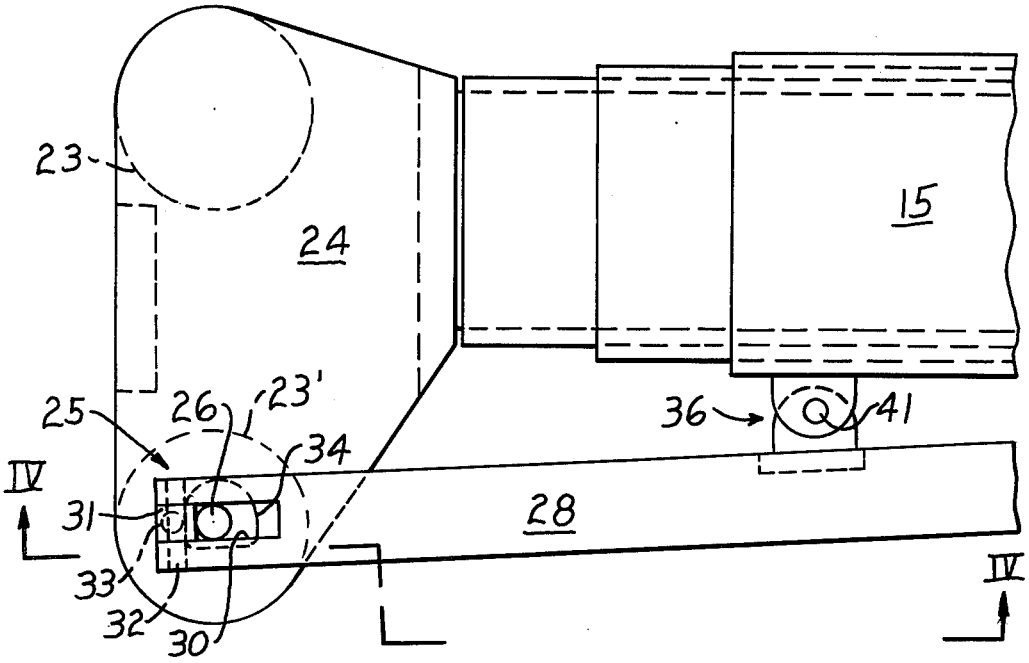
FIG. 3 is an enlarged view of portions of the boom and jib, taken in the direction of arrows III—III in FIG. 2.
Figure 6:
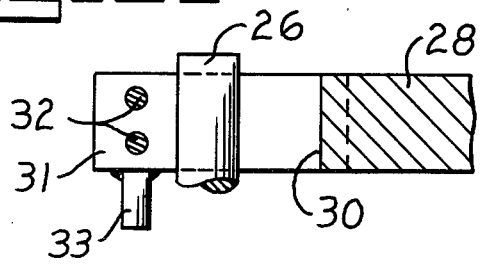
FIG. 6 is a sectional view, taken in the direction of arrows VI—VI in FIG. 5.
Figure 8:
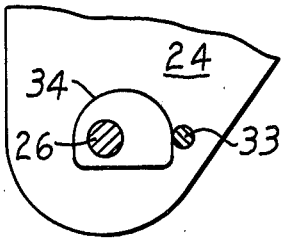
FIG. 8 is a sectional view, taken in the direction of arrows VIII—VIII in FIG. 7.
Figure 5:
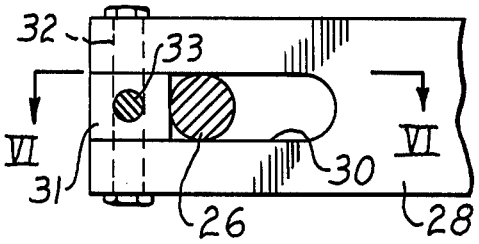
FIG. 5 is a sectional view, taken in the direction of arrows V—V in FIG. 4.

FIGS. 1 and 2 illustrate a crane 10 comprising a mobile vehicle 11, such as a wheel-type tractor, comprising a lower frame or undercarriage 12 mounted on four roadwheels 13. Alternatively, the crane could be mounted on a pair of laterally spaced track assemblies of conventional design. An upper frame 14 is mounted in a conventional manner on the lower frame for rotational movements thereon. A rearward end of a boom 15 is pivotally mounted at 16 on the upper frame, rearwardly of an operator's station 17 which is mounted on the upper frame in offset relationship relative to the boom.

Actuating means for selectively raising and lowering the boom relative to ground level may comprise a single double-acting hydraulic cylinder 18 pivotally interconnected between frame 14 and boom 15 by pivot pins 19 and 20, respectively. The cylinder is disposed directly under the boom and the boom and the cylinder are disposed in offset relationship on one lateral side of the operator's station or cab, along with a jib 21, to afford the operator with substantially unobstructed visibility forwardly of the vehicle. A first winch assembly 22 is mounted on frame 14, rearwardly of boom 15 and operator's station 16, to pay-out and pay-in a line $L_1$ entrained over one of a double sheave 23 rotatably mounted on a forward end of the boom.

The free end of line $L_1$ may have a hook H (FIG. 1) or other work tool, such as a bucket, attached thereto for work performing purposes. The boom is preferably constructed as a conventional hydraulically actuated telescopic cylinder whereby selective extension and retraction thereof may be effected under the control of the operator. Sheave 23 is rotatably mounted on a bracket 24, secured on a forward end of boom 15 to form an integral part thereof, which also mounts a rearward end of jib 21 thereon by an attachment means 25.

Referring to FIGS. 3–6, attachment means 25 comprises a transversely disposed pin 26 secured to bracket 24 vertically below the longitudinal axis of the boom proper to pivotally mount a pair of laterally spaced arms 27 and 28 of the jib on either of a respective side of the bracket. Jib arm 27 has an opening 29 formed therethrough which defines arcuate bearing surfaces thereon to pivot the member on pin 26. Sufficient clearance is provided between opening 29 and the pin to permit the jib to swing from its stored position illustrated in FIG. 4 to its extended position illustrated in FIG. 7.

Jib arm 28 has an elongated slot 30 formed through the end thereof to receive the opposite end of pin 26 therein. The pin is captured in the slot by a block 31 which is secured in an open end of the slot by a pair of pins 32. A cross or follower pin 33 is secured to block 31 to extend inwardly therefrom to engage an arcuate cam 34, formed on an outboard side of bracket 24.

Figure 4:
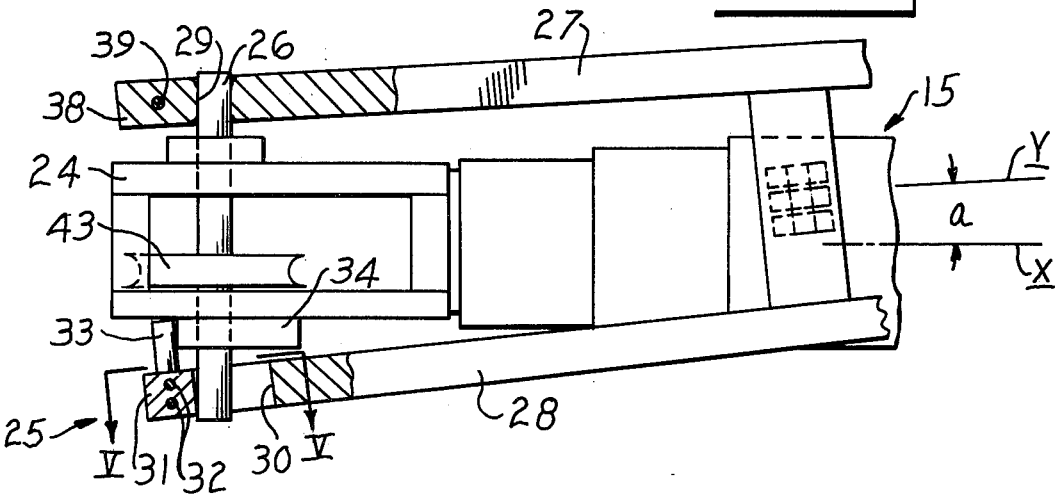
FIG. 4 is an enlarged top plan and partially sectioned view, taken in the direction of arrows IV—IV in FIG. 3.

When the jib is maintained in its stored position illustrated in FIGS. 1, 2 and 4, such as by bracket connections 35 and 36, a longitudinal axis X of boom 15 will be located in a vertical plane disposed at an acute angle a relative to a vertical plane containing a longitudinal axis Y of jib 21. Thus, the forward end of the jib, having a sheave 37 rotatably mounted thereon, will be disposed in laterally offset relationship relative to the boom. The crane can thus be driven to a remote job site with the driver being afforded substantially unobstructed visibility forwardly and to the sides of the crane.

A block 38 aids in defining opening 29 and is secured in a slot formed in the end of jib arm 27 by a pin 39. Thus, upon removal of pins 32 and 39, blocks 31 and 38 can be removed from jib arms 28 and 27, respectively. Such removal allows the boom to be used without the stored jib since pin 26 is easily removed from the open slots formerly accommodating blocks 31 and 38 therein.

Figure 7:
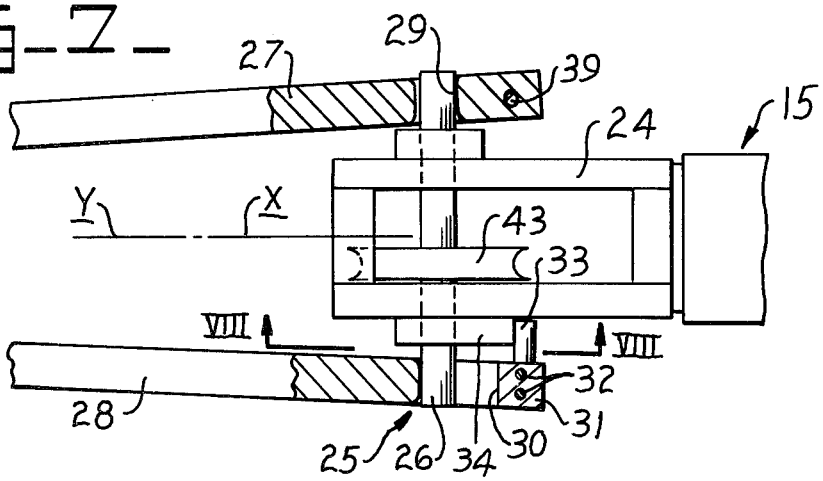
FIG. 7 is a view similar to FIG. 4, but showing the jib in an extended position forwardly of the boom.

Upon arrival at a job site, a pin 40 is removed from bracket connection 35 and a pin 41 is removed from connection 36 to thus condition jib 21 for extension forwardly of boom 15, after blocks 31 and 38 have been positioned in their respective slots and retained therein by pins 32 and 39. The boom may be raised by cylinder 18 to permit the jib to swing generally vertically and forwardly of vehicle 10 whereby pin 33 will track around cam 34. As the above occurs, the tension imposed on a jib line $L_2$, having an end secured to bracket connection 35 on the forward end of the jib resulting from pulling jib 21 into position, forwardly of the vehicle will tend to keep the jib in line with boom 15. The pin 33 and cam 34 combination will keep side loads from shifting jib 21 sideways as pin 26 moves in slot 30, i.e., the pin and cam will remain in contact throughout swinging movements of the jib. The pin and cam combination cooperates with the elongated slot connection provided by pin 26 and slot 30 and the clearance afforded between opening 29 and the pin to dispose the longitudinal axes X and Y of the boom and jib within the same vertical plane, as illustrated in FIG. 7.

A second winch 42 mounted on frame 14 rearwardly of winch 22, is adapted to pay-out line $L_2$ which entrains over the second one of double sheave 23 and a sheave 43 rotatably mounted on pin 26. Line $L_2$ is attached to the bracket connection 35 on the end of the jib from which pin 41 was removed to selectively raise (or lower) the jib relative to the boom. Line $L_1$ may be operated simultaneously with the operation of line $L_2$, once the jib is in its working position with line $L_1$ entrained over sheave 37 for work purposes. Alternatively, the jib could be adjustably suspended forwardly of the boom in a conventional manner by lines (not shown) attached between the forward ends of the jib and boom. Thus, a dual work capacity would be provided whereby line $L_1$ would be entrained over pulleys 23 and 43 and line $L_2$ would be entrained over pulleys 23 and 37 with the ends of both lines each having a work tool attached thereto.

What is claimed is:

1. A crane comprising a mobile vehicle having a frame, a boom having a rearward end thereof pivotally mounted on said frame, actuating means interconnected between said frame and said boom for selectively raising and lowering said boom relative to ground level, a jib, and attachment means attaching a rearward end of said jib to a forward end of said boom for permitting said jib to be moved between (1) a stored position adjacent to said boom wherein a longitudinal axis of said jib is located in a vertical plane forming an acute angle relative to a vertical plane containing a longitudinal axis of said boom therein to position a forward end of said jib in laterally offset relationship relative to said boom and (2) an extended position forwardly of said boom wherein the longitudinal axis of each of said jib and said boom are contained within the same vertical plane, said attachment means comprising a pin secured on the forward end of said boom and wherein said jib comprises a pair of first and second laterally spaced arms disposed on a respective side of said boom and pivotally mounted on said pin, a first end of said pin being disposed in an opening formed through the first arm of said jib to define sufficient clearance thereat for permitting said jib to be moved from its stored position to its extended position forwardly of said boom, a second end of said pin being disposed in an elongated slot formed through the second arm of said jib, a block disposed at an open end of said slot and secured therein and an arcuate cam secured on an outboard side of the forward end of said boom and a pin secured to said block and having an end thereof disposed on said cam.

2. A crane comprising:

a mobile vehicle frame;

a boom with a forward end, rear end and a longitudinal axis extending therebetween;

means pivotally mounting said rear end of said boom to said vehicle frame;

means interconnected between said boom and said frame for selectively pivoting said boom on said frame;

a jib with a forward end, rear end and a longitudinal axis extending therebetween, a pair of laterally spaced arms located at said rear end of said jib;

attachment means for pivotally attaching one of said arms on a respective side of the forward end of said boom;

said attachment means including mounting means secured to the forward end of said boom for pivotally mounting said jib thereon for movement about a horizontal axis;

means mounted on the rear end of said jib and operatively engaged with said mounting means such that in response to the movement of said jib about said horizontal axis, said jib is operative to move between (1) a stored position beneath said boom wherein said longitudinal axis of said jib is located in a vertical plane forming an acute angle relative to a vertical plane containing said longitudinal axis of said boom therein so that the longitudinal axis of said jib at the rearward end thereof intersects the axis of said boom to position a forward end of said jib in a laterally offset relationship relative to said boom while maintaining each of said arms on said boom and (2) an extended position forwardly of said boom wherein the longitudinal axis of each of said jib and said boom are contained within the same vertical plane while still maintaining each of said arms on said boom.

* * * * *